US005386651A

United States Patent [19]

Okamoto

[11] Patent Number: 5,386,651

[45] Date of Patent: Feb. 7, 1995

[54] FITTING STRUCTURE OF SPIKES OR THE LIKE FOR SPORT SHOES

[75] Inventor: Mutsue Okamoto, Hyogo, Japan

[73] Assignee: Hyogo Shoes Co., Ltd., Hyogo, Japan

[21] Appl. No.: 213,838

[22] PCT Filed: Mar. 30, 1990

[86] PCT No.: PCT/JP90/00431

§ 371 Date: Oct. 7, 1991

§ 102(e) Date: Oct. 7, 1991

[87] PCT Pub. No.: WO90/11699

PCT Pub. Date: Oct. 18, 1990

Related U.S. Application Data

[63] Continuation of Ser. No. 768,850, Oct. 7, 1991, abandoned.

[30] Foreign Application Priority Data

Apr. 7, 1989 [JP] Japan ..... 1-89267

[51] Int. Cl.[6] ..... A43B 5/00; A43C 15/16

[52] U.S. Cl. ..... 36/134; 36/67 D

[58] Field of Search ..... 36/134, 62, 65, 66, 36/67 D

[56] References Cited

U.S. PATENT DOCUMENTS

| | | | |
|---|---|---|---|
| 1,728,010 | 9/1929 | Sheill | 36/67 D |
| 1,760,084 | 5/1930 | Pierce | 36/67 D |
| 1,942,574 | 1/1934 | Shapiro . | |
| 2,009,947 | 7/1935 | Powning . | |
| 2,026,280 | 12/1935 | Kerin | 36/67 D |
| 2,470,997 | 5/1949 | McKenzie | 36/67 D |
| 2,682,714 | 7/1954 | Phillips | 36/67 D |
| 3,029,529 | 4/1962 | Schwartz | 36/134 X |
| 3,195,246 | 7/1965 | Ueda | 36/67 D |
| 3,204,347 | 9/1965 | Snow | 36/67 D X |
| 3,844,056 | 10/1974 | Kwan | 36/67 D |
| 4,299,038 | 11/1981 | Epple | 36/67 D |
| 4,590,693 | 5/1986 | Kawashima et al. | 36/126 |
| 4,633,600 | 1/1987 | Dassler et al. | 36/67 D X |
| 4,922,636 | 5/1990 | Chen | 36/67 D X |

FOREIGN PATENT DOCUMENTS

| | | |
|---|---|---|
| 0175302 | 6/1954 | Japan . |
| 55-175302 | 12/1980 | Japan . |
| 796387 | 6/1958 | United Kingdom . |

*Primary Examiner*—Paul T. Sewell
*Assistant Examiner*—Ted Kavanaugh
*Attorney, Agent, or Firm*—Birch, Stewart, Kolasch & Birch

[57] ABSTRACT

This invention relates to a fitting structure of spikes or the like for sport shoes. A joint nut or joint bolt meshing with a nut portion of a fitting base and meshing, on the other hand, with a fitting nut or bolt is interposed when spikes or the like are removably fitted to the fitting base buried in and fixed to the sole of the bottom of the shoes main body, in order to enlarge the fixing contact area of the spike or the like and to improve fixing strength. The joint nut or bolt first undergoes deformation prior to the fitting base when the load deformation force acting on the spike portion is received, the load to the fitting base is thus reduced and durability can be improved. The damaged joint nut or bolt is replaced by a new one.

9 Claims, 7 Drawing Sheets

FITTING STRUCTURE OF SPIKES OR THE LIKE FOR SPORT SHOES

This application is a continuation of application Ser. No. 07/768,850 filed on Oct. 7, 1991, now abandoned.

BACKGROUND OF THE INVENTION

1. Field of the Invention

The present invention relates to a fitting structure of spikes or the like for sport shoes, particularly to a mounting structure of spikes or the like, by which mounting bases embedded in a sole are protected and damaged mounting components can be replaced by new mounting components.

2. Description of Related Art

It is necessary often to kick the ground during practice or playing games of sports such as baseball, soccer and the like. Accordingly spikes, studs or the like as an assisting means for kicking the ground by shoes are generally provided on the bottom of a shoe.

For example, in a soccer shoe, as shown in FIG. 8, a stud 62 made of synthetic resin is fixed to the head part 61 of a metallic bolt 60. The metallic bolt 60 conjugated with and fixed to the stud 62 is detachably fixed in a screwed manner to a nut part 64 provided at a metallic mounting substrate 65 in a sole 63 comprising the bottom of a shoe body. In a baseball shoe, as shown in FIG. 9, a nut part 64 provided in the metallic mounting substrate 65 is provided in the insertion hole of the sole 63, and the metallic bolt 60 is detachably fixed in a screwed manner so as to fit the spike 66 to the sole 63. It is advantageous in such mounting structures of a spike or the like for sport shoes that the stud, the spike or the mounting bolt are replaceable by removing the bolt in the case that the stud or the spike are damaged or the locking bolt is damaged and deformed.

However, in the above-mentioned conventional mounting structures of spikes or the like, in the case of damaging the nut part 64 provided in the mounting substrate, the entire mounting substrate must be removed from the sole. This raises the problems that such an operation is very complicated and causes damage in the bottom of the shoe, thus deteriorating its durability and wearability.

In another conventional mounting structure of spikes or the like, as shown in FIG. 10, a mounting base 67 made of a synthetic resin material is embedded and fixed in the sole 63. In such a structure, a cushion material can be mounted on the sole and the problem concerning the strength of screwed engagement with the mounting bolt and the mounting base can be solved, but in the case of damaging in the mounting base or the nut part, such a problem that not only the mounting base but also the sole must be replaced is caused. Accordingly in view of the conventional problems, a main object of the present invention is to provide a mounting structure of spikes or the like for sport shoes, by which a mounting base embedded in the sole can be protected, the replacement of the other components can be carried out easily and the duration of the shoe usage can be increased.

SUMMARY OF THE INVENTION

According to a first aspect of the present invention, there is provided a structure in which spikes or the like are detachably fitted to a sole forming a bottom of a shoe body, comprising:

a mounting base in which a nut screwed part is opened downward, embedded and fixed in the sole;

a joint nut provided with an inner screwed part and an outer screwed part in which the inner part opening downward is formed and the outer part is engaged detachably in a screwed manner with the nut part of the mounting base; and locking bolts for fixing the spikes or the like to the mounting base, to be engaged detachably in a screwed manner with the inner part of the joint nut.

According to a second aspect of the present invention, there is provided a mounting structure of spikes or the like for sport shoes comprising a mounting base in which a nut screwed part is opened downward, embedded and fixed in the sole;

a joint bolt provided with an outer screwed part and a bolt part to be engaged detachably in a screwed manner with the nut screwed part of the mounting base in which the bolt part protrudes downward from the outer screwed part; and a locking nut for fixing the spikes or the like to the mounting base, engaged detachably in a screwed manner with the bolt part of the joint bolt.

Herein, a shoe body is defined as a sport shoe which requires spikes or the like. The shoe body and its bottom part can be formed of conventional materials such as leather or synthetic resin materials. The sole includes various forms for the shoe bottom and can be made of synthetic resin materials such as nylon, urethane and the like.

The aforementioned mounting base is defined as a mounting part on the sole and usually formed separately from the sole due to the difference in properties of their materials. Upon forming the sole with resin, the mounting bases can be embedded and fixed inside of the sole. When the two-step molding method is applied for making a sole, the sole is formed at a first stage followed by a second stage of fixing the mounting bases to the outside of the sole with resin in such a manner that the mounting bases are embedded therein. For the purpose of facilitating the positioning of a plurality of the mounting bases upon embedding in the sole, it is desirable to form blocks 4', 4'', 4''' by a combination of a plurality of mounting bases positioned with respect to each other and embed the blocks therein (See FIG. 11).

Each mounting base includes a nut body part but also an outer circle flange part (See FIGS. 3, 5 and 7) to preferably give the anchor effect upon embedding and fixing. Each mounting base may be formed integrally with a metallic material, a synthetic resin material or the like. In place of the above type, a nut part formed separately may be engaged firmly with an insertion hole.

The joint nut and the joint bolt here mean elements for combining the mounting base and each spike or the like which will be mentioned below. The joint nut generally have an outer screwed part to be engaged with the inner screwed nut part of each aforementioned mounting base and an inner screwed part to be engaged with a locking bolt part of each spike or the like. On the other hand, the joint bolt generally has an outer screwed part to be engaged with the inner screwed nut part of each aforementioned mounting base and a bolt part to be engaged with a mounting nut part of each spike or the like, but other modes of engagement may be applied as long as locking of spikes or the like with the joint nut and bolt is possible. For example, since the main function of the joint nut and bolt is to receive excessive load applied to each spike or the like and break in preference to each nut part of the mounting base so as to protect the nut part, as a means for engagement of the joint nut or bolt with each spike, any other detachable engaging element except a screw means and if necessary adhesive composition may be employed and both the joint nut or bolt and the spike can be replaced at the same time.

Further in the aforementioned joint nut and the joint bolt, engagement holes (corresponding to holes 51 in FIGS. 3 and 5 and holes 82 in FIG. 7) to be engaged with a mounting tool are preferably formed in order that the joint nut and the joint bolt can be engaged with or disengaged from each mounting base.

Spikes or the like as defined in the claims mean spikes and studs to be fitted to the sole forming the bottom of the shoe body. The spikes or the like may be formed separately from (See FIG. 5) or fixed integrally to the respective locking bolts or the locking nuts (See FIG. 3).

The size of each joint nut to be engaged with the nut part of each locking base or the separate nut may be so prescribed as to have some thickness so that the conventional locking bolt for a spike may be used (See FIG. 3). A joint nut 5' may also be made thin like a spring and formed into a shape so as to provide a screw inside and outside thereof (See FIG. 12).

According to the present invention, each mounting base, each separate nut part, each joint nut and bolt and each mounting nut and bolt may be formed of some synthetic resin material or metallic material, but they may also be formed with combined use of different materials. Particularly, in view of the function of the joint nut and bolt, that is the function of avoiding damage in each mounting base and separate nut parts embedded in the sole, both involving difficulties in replacement, the joint nut and bolt is preferably made of a material having less strength than the nut screwed part, such as, for example, synthetic resin materials as nylon, urethane and the like and soft metallic materials as Al and the like, so that the joint nut and bolt receive the load to break in preference to the mounting base and so on.

Function

In the present invention, since the mounting bases are embedded and fixed in the sole beforehand, it is possible to mount a cushion material on the sole. Furthers. the joint nut or the joint bolt is mounted between each mounting base and each locking bolt or locking nut, accordingly the fixing contact area is increased and the fixing strength is improved. In addition, even in the case that a load sufficient to break the nut part of each mounting base is applied, the joint nut or the joint bolt absorbs the load, which results in significantly decreased chance of damaging the nut part of each mounting base. Further, the load received by the spike part does not act directly on the mounting bases through each mounting bolt or nut, but it acts on the mounting bases and the sole through each joint nut or bolt and accordingly local action of the load received by the spike part on the sole can be avoided. Thus combined with the aforementioned protection action, the durability of the mounting structure of the spike can be significantly improved. Even when the joint nut and bolt are damaged, only replacement of the joint nut and bolt is necessary.

BRIEF DESCRIPTION OF THE DRAWINGS

FIG. 5 is an exploded view in perspective of the fitting structure of spikes or the like;

FIG. 7 is an exploded view in perspective of the fitting structure of spikes or the like;

FIG. 8 shows a conventional fitting structure of spikes or the like;

FIG. 9 shows a conventional fitting structure of spikes or the like;

FIG. 10 further shows another conventional fitting structure of spikes or the like;

DETAILED DESCRIPTION OF PREFERRED EMBODIMENTS

The preferred embodiment of the present invention will be explained hereafter with reference to the accompanying drawings.

Figure 1:
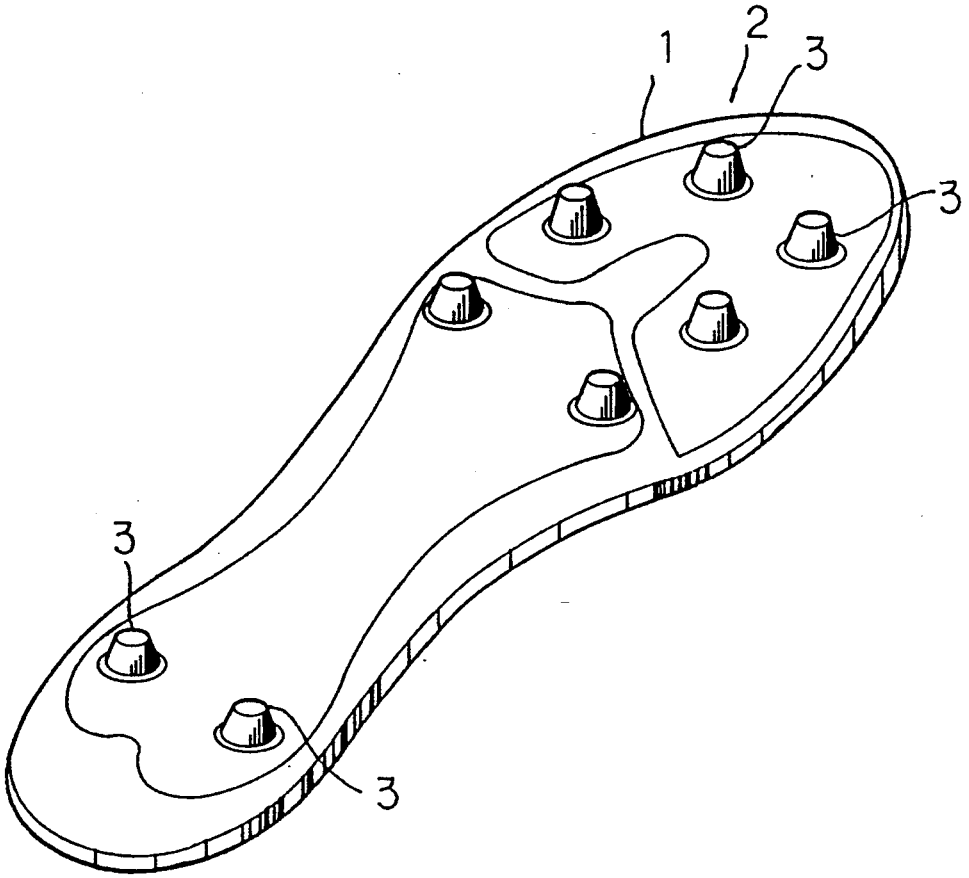
FIG. 1 is a perspective view showing a fitting structure of spikes or the like according to an embodiment based on the first aspect of the present invention.
Figure 2:
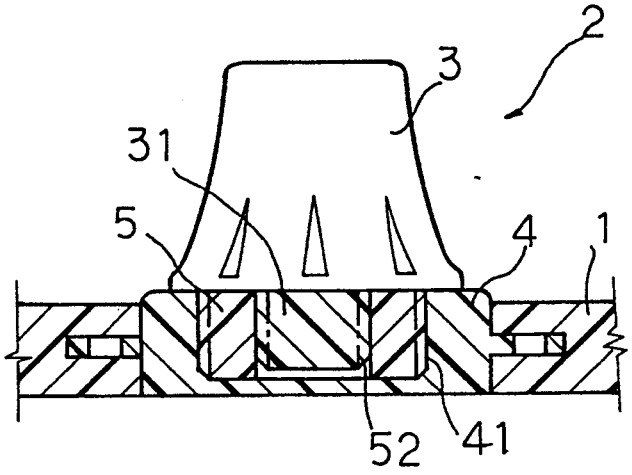
FIG. 2 is a sectional view showing main components of the structure.
Figure 3:
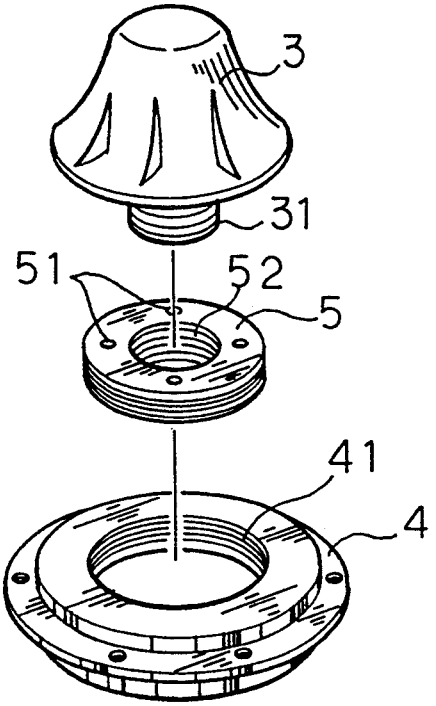
FIG. 3 is an exploded view in perspective of main components of the structure.

FIGS. 1 to 3 illustrate a fitting structure of spikes or the like for sport shoes according to an embodiment of the first invention, in which the mounting structure is applied to a soccer shoe. In the drawings element 1 denotes a sole. The sole 1 is manufactured by means of the injection molding method with use of a synthetic resin material such as nylon or urethane and fixed firmly to a bottom part of a shoe body so as to provide a sole bottom part. Studs 3 are detachably fixed to the sole 1 by means of a fitting structure 2 of this example.

In the fitting structure 2, six of mounting bases 4 made of a synthetic resin material such as nylon, urthane and the like are embedded and fixed in the front part and two of these in the back part. A nut screwed part 41 opening downward is formed in each mounting base 4. A joint nut 5 is engaged in a screwed manner with the nut part 41. The joint nut 5 is made of a synthetic resin material such as nylon, urthane and the like. Engagement holes 51 to be engaged with a mounting tool (not shown) for having the joint nut 5 engaged in a screwed manner with and disengaged from the nut part 41 of each mounting base 4 is formed in the joint nut 5. On the other hand, the aforementioned stud 3 is formed of a synthetic resin material such as nylon, urthane and the like. A locking bolt 31 is integrally formed in the stud 3 and detachably engaged in a screwed manner with an inner screwed part 52 of the joint nut 5. Thus, the stud 3 is detachably fixed to the sole 1.

The action and the effect will now be explained.

When manufacturing the shoes, while the shoe body is manufactured with use of leather and the like in the conventional manner, the mounting bases 4 are set at a prescribed position in a sole injection mold so as to form the sole 1 by means of the injection molding method. Then the sole 1 having the mounting bases 4 embedded and fixed therein is fixed firmly to the bottom part of the shoe body and a mounting tool is engaged with the engagement holes 51 of the joint nut 5 so as to screwedly engage the joint nut 5 with the nut screwed part 41 of each mounting base 4. Further the mounting bolt 31 of each stud 3 is attached in a screwed manner to the joint nut 5.

In the fitting structure of the present embodiment as described above, each mounting base 4 is embedded and secured in the sole 1, such that the fixing strength of each mounting base 4 and the bolt 31 of each stud 3 is ensured. Further this mounting structure enables a cushion material to be mounted on the sole 1 and thus the range of the selection of cushion materials is extended.

In sport shoes of this kind, metal mountings for fixing studs sometimes push up a sole by an impact during exercise, thus causing pain. Due to this, in mounting structures of spikes or the like in the conventional sport shoes, a cushion such as fibers and the like is further employed under an insole pad or an insole pad is made thick for the protection from the pushes. However, sufficient protection cannot be obtained nevertheless. On the contrary, in the fitting structure according to the present invention, since the mounting bases 4 are embedded and secured in the sole 1 and the nut part 41 of each mounting base 4 is made in a double manner by the joint nut 5, an impact received by a stud is absorbed in preference to the nut part 41 and relieved by the joint nut. In addition to the effect of dispersion and relief of the pushing strength from the mounting bases 4, a cushion material may be laid on the sole 1 as mentioned above, thus the problem of the pushes to a sole can be substantially completely solved. Further, when a soft joint nut 5 is mounted between the nut part 41 of each mounting base 4 and each locking bolt 31, if a large load is applied to the nut part 41, the joint nut 5 having a smaller diameter than the nut part 41 is deformed and damaged by absorbing the load in preference to the nut part 41, thereby preventing the nut part 41 from being damaged. As a result, only a simple operation to replace the joint nut 5 must be carried out compared to the replacement of the entire sole as in the conventional practice, and the replacement operation of the damaged structural parts can be remarkably simplified. For the purpose of making such effects more ensured, the nut part 41 may be made of a metallic material such as iron and the like while the strength of the joint nut 5 is made less than that of the nut part 41.

In addition, due to separately providing a part to absorb a load, the sole 1 can be formed thin, which results in advantages in view of costs and appearances.

Further, since all of the sole 1, the mounting bases 4, the joint nuts 5, the locking bolts 31 and the studs 3 can be made of a synthetic resin material because of the joint nut insertion, the sole can be made lightweight compared to the conventional soles employing metals.

In addition, in the conventional fitting structures of spikes or the like, after bonding a sole, an insertion hole for burying a nut is penetrated from an insole through the sole and then spikes or the like are fitted thereto. Thus the production process is complicated and requires much labor. On the contrary, in the fitting structure according to the present invention, since the mounting bases 4 are embedded and secured in the sole 1, a spike or the like can be fixed in advance to the sole 1 and then the sole 1 can be bonded to the shoe body. Thus the production process can be simplified. Also in the case of a so-called direct solving operation, a series of above-mentioned operation can be carried out at a time, thereby increasing the operation efficiency and decreasing the costs.

Figure 4:
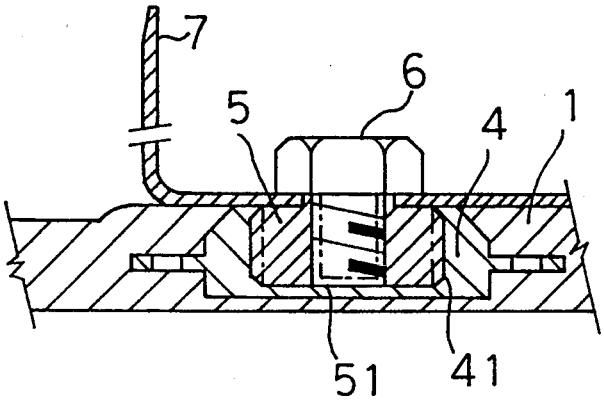
FIG. 4 is a sectional view showing a fitting structure of spikes or the like according to another embodiment of the first aspect of the present invention.
Figure 5:
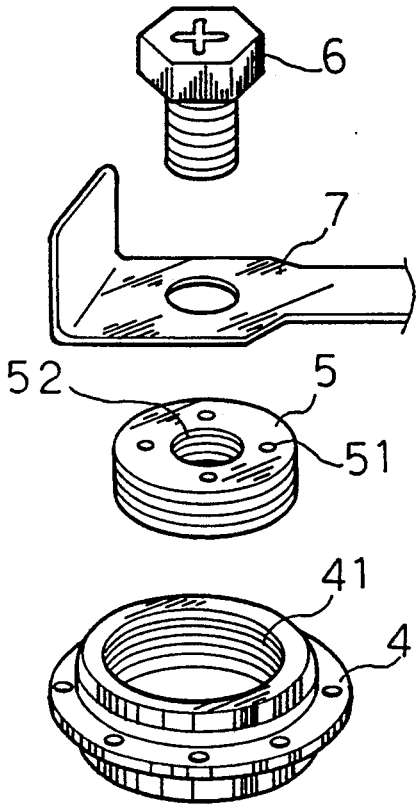

FIGS. 4 and 5 illustrate a fitting structure of spikes or the like of sport shoes according to another embodiment of a first invention, in which the mounting structure is applied to a baseball shoe. In this example, each mounting base 4 made of an iron-containing metal is embedded and fixed in the sole 1, with its nut screwed part 41 opening downward. The joint nut 5 made of a metal of the iron or aluminum is provided with an inner screwed part 52 and an outer screwed part 53 and is detachably engaged in a screwed manner with the nut part 41 by the outer screwed part 53. The inner screwed part 52 opening downward is formed in the joint nut 5. A locking bolt 6 made of a metal of the iron or the aluminum is detachably fixed in a screwed manner to the inner screwed part 52 of the joint nut 5. A spike (or the like) 7 is fixed to each mounting base 4 through the joint nut 5 by the mounting bolt 6. A size of each of the components is preferably prescribed so that a conventional spike 7 or locking bolt 6 may be used.

Figure 6:
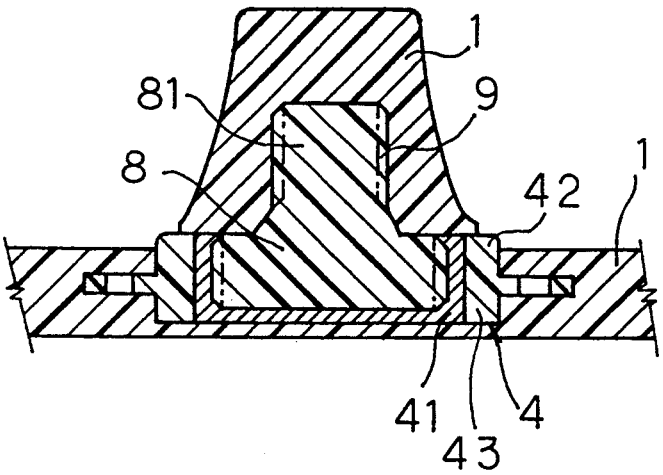
FIG. 6 is a sectional view showing a fitting structure of spikes or the like for sport shoes according to an embodiment of a second aspect of the present invention.
Figure 7:
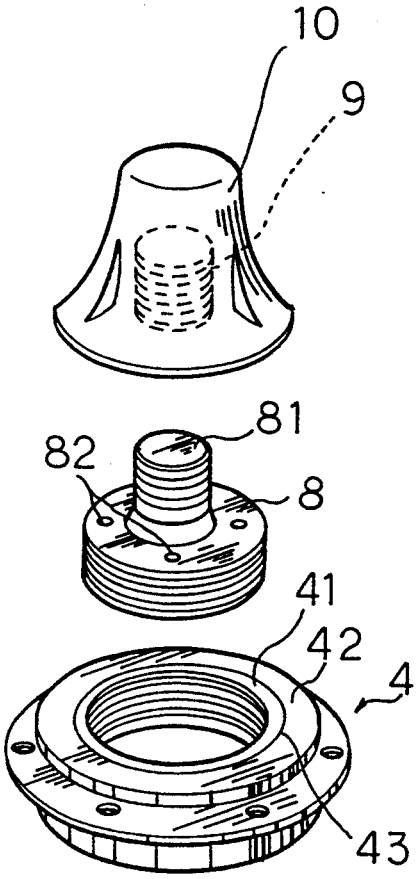
Figure 8:
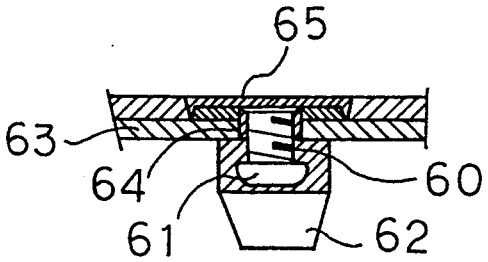
FIG.8 (CONVENTIONAL ART)
Figure 9:
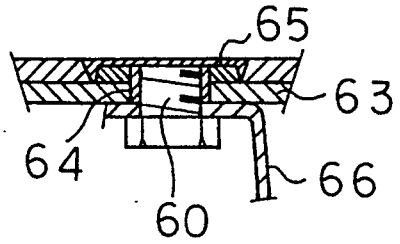
FIG.9 (CONVENTIONAL ART)
Figure 10:
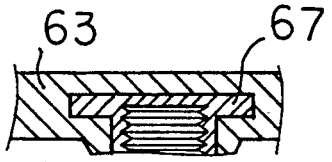
FIG.10 (CONVENTIONAL ART)
Figure 11:
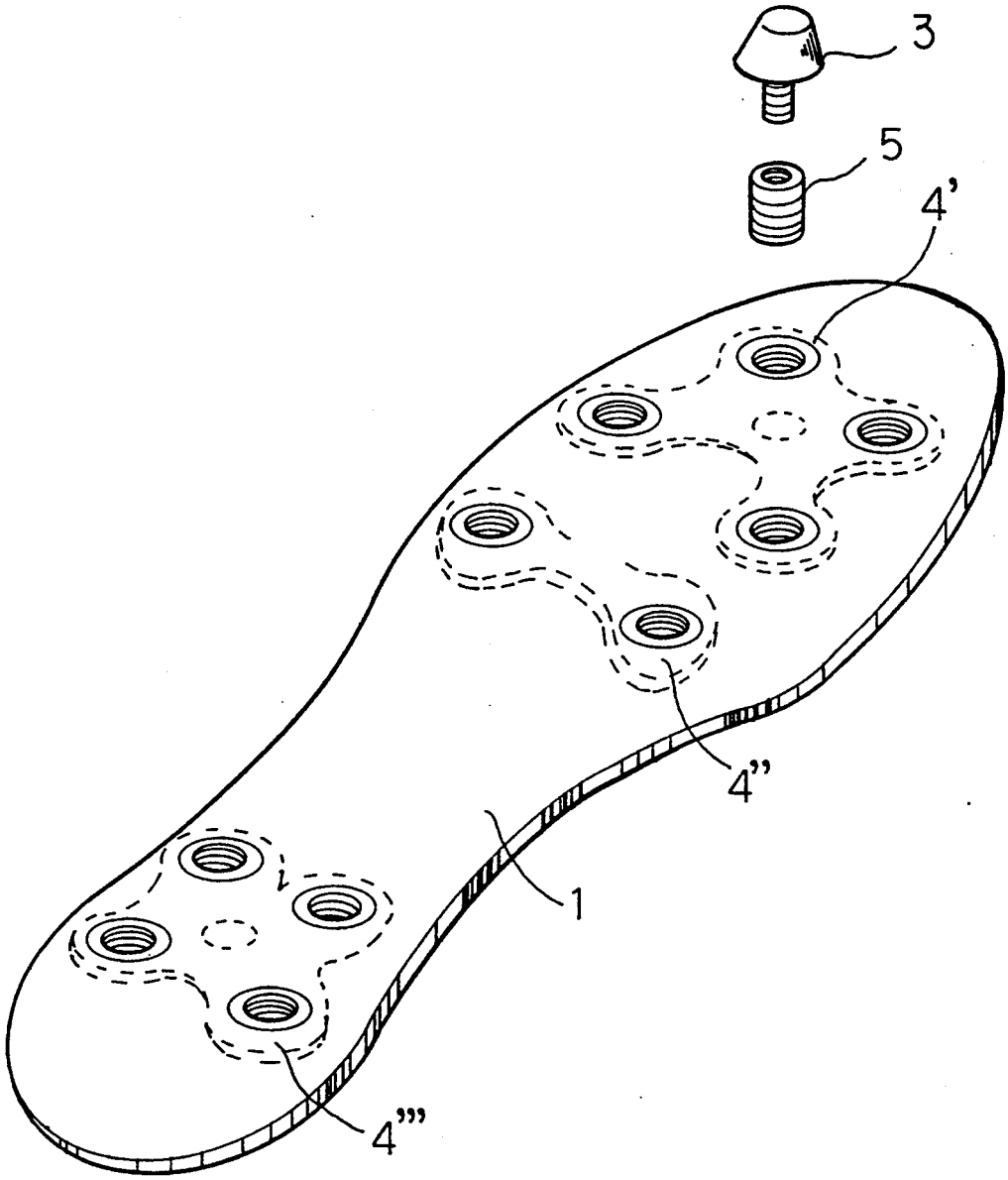
FIG. 11 is a perspective view showing blocks made of a combination of a plurality of mounting bases according to the present invention.
Figure 12:
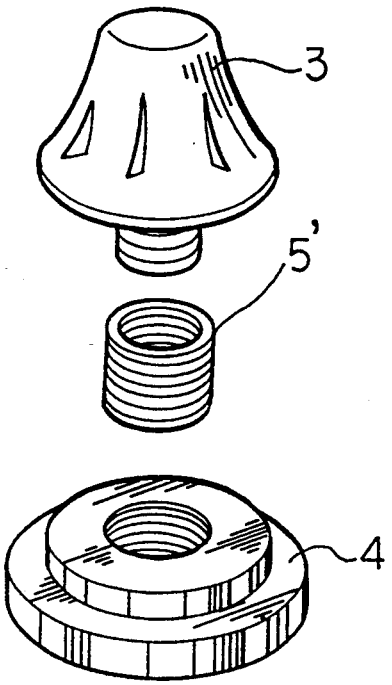
FIG. 12 is an exploded view in perspective of assemblies of a thin-type joint nut.

FIGS. 6 and 7 illustrate a fitting structure of spikes or the like according to an embodiment of a second invention. In this example, the nut screwed part 41 made of a metal of the iron group is engaged with and fixed to an insertion hole 43 of a mounting base body 42 made of synthetic resin so as to form each mounting base 4. While a joint bolt 8 provided with a smaller diameter bolt part 81 and a larger diameter and outer screwed part is employed instead of the joint nut 5 used in the above-described examples, a mounting nut 9 and a stud 10 are formed in one body so as to be fixed in a screwed manner to the smaller diameter joint bolt part 81 of the joint bolt 8. The materials used are not limited to those mentioned in the above examples, but appropriate materials may be suitably selected.

Industrial Utilization

As can be seen from the above, according to a fitting structure of spikes or the like of the present invention, mounting bases are embedded and secured in a sole at the bottom of a shoe body, a joint nut or a joint bolt is detachably fixed in a screwed manner to a nut part of each mounting base, and a locking bolt or a locking nut is detachably fixed in a screwed manner to the joint nut or the joint bolt so as to fix each mounting base firmly to a spike or the like, which results in making the fixation of the spike or the like ensured and decreasing a load to each mounting base hence improving durability. Additionally, since damages usually given to each component are entirely covered by the joint nut or bolt, the replacement operation of damaged parts can be simplified by only replacement of the joint nut and bolt. Further due to the effect of increased choice of materials for a cushioning material, the mounting structure which improves durability of sport shoes can be widely used.

What is claimed is:

1. A fitting structure of spikes for sport shoes in which spikes are detachably fitted to a sole forming a bottom of a shoe body, comprising:

a mounting base formed of a metal material and embedded and fixed in said sole;

an inner threaded opening in said mounting base defining an insertion hole;

a joint nut to be engaged detachably in a screwed manner with the inner threaded opening of said mounting base in which a nut screwed part opening downward is formed; and a locking bolt for fixing said spike to said mounting base, to be engaged detachably in a screwed manner with the nut screwed part of said joint nut, wherein a material of said joint nut is weaker in deforming strength than the material of said mounting base for absorbing deformation at the joint nut prior to absorbing deformation at said mounting base.

2. The fitting structure of spikes for sport shoes, according to claim 1 wherein engagement holes are formed in said joint nut so that said joint nut may be engaged with and disengaged from the inner threaded opening of said mounting base in a screwed manner by means of fitting tools.

3. The fitting structure of spikes for sport shoes, according to claim 1, in which said mounting base is embedded and fixed upon forming the sole with resin.

4. The fitting structure of spikes for sport shoes, according to claim 1, in which the locking bolt part of said spike comprises a locking bolt separate from a spike body.

5. The fitting structure of spikes for sport shoes, according to claim 1, wherein said joint nut is made of a material different from a material of the inner threaded opening of said mounting base.

6. A fitting structure of spikes for sport shoes in which spikes are detachably fitted to a sole forming a bottom of a shoe body, comprising:

a mounting base formed of a metal material and embedded in said sole, said mounting base including an inner threaded opening defining an insertion hole, an outer flange portion provided with a plurality of engagement holes formed therethrough, and a base portion capping off one opening of the insertion hole;

a joint bolt from which a bolt part protrudes downward, to be engaged detachably in a screwed manner with the inner threaded opening of said fitting base; and a locking nut for fixing said spikes to said mounting base, to be engaged detachably in a screwed manner with the bolt part of said joint bolt, wherein a material of said joint bolt is weaker in deforming strength than the material of said mounting base for absorbing deformation at the joint bolt prior to absorbing deformation at said mounting base.

7. The fitting structure of spikes for sport shoes, according to claim 6, wherein engagement holes are formed in said joint bolt so that said joint bolt may be engaged with and disengaged from the inner threaded opening of said mounting base in a screwed manner by means of mounting tools.

8. The fitting structure of spikes for sport shoes, according to claim 6, in which said mounting base is embedded and fixed upon forming the sole with resin.

9. The fitting structure of spikes for sport shoes, according to claim 6, wherein said joint bolt is made of a material different from a material of the inner threaded opening of said mounting base.

* * * * *